US008534088B2

(12) United States Patent
Lee et al.

(10) Patent No.: US 8,534,088 B2
(45) Date of Patent: Sep. 17, 2013

(54) CONTROLLING METHOD OF ICE MAKER

(75) Inventors: Tae Hee Lee, Seoul (KR); Hong Hee Park, Seoul (KR); Joon Hwan Oh, Seoul (KR); Young Jin Kim, Seoul (KR); Kwang Ha Suh, Seoul (KR)

(73) Assignee: LG Electronics Inc., Seoul (KR)

( * ) Notice: Subject to any disclaimer, the term of this patent is extended or adjusted under 35 U.S.C. 154(b) by 984 days.

(21) Appl. No.: 12/173,259

(22) Filed: Jul. 15, 2008

(65) Prior Publication Data

US 2009/0019866 A1 Jan. 22, 2009

(30) Foreign Application Priority Data

Jul. 16, 2007 (KR) ..... 10-2007-0071151

(51) Int. Cl.
*F25C 5/08* (2006.01)

(52) U.S. Cl.
USPC ..... 62/351; 62/73

(58) Field of Classification Search
USPC ..... 62/73, 351
See application file for complete search history.

(56) References Cited

U.S. PATENT DOCUMENTS

| | | | | |
|---|---|---|---|---|
| 5,553,744 | A * | 9/1996 | Sawyer, III | 222/64 |
| 2006/0086107 | A1 | 4/2006 | Voglewede | |
| 2006/0086134 | A1 * | 4/2006 | Voglewede et al. | 62/351 |
| 2006/0272340 | A1 * | 12/2006 | Petrenko | 62/73 |

FOREIGN PATENT DOCUMENTS

| | | | |
|---|---|---|---|
| JP | 06-241626 | | 9/1994 |
| JP | 06-273014 | | 9/1994 |
| JP | 2007-057198 | | 3/2007 |
| KR | 1999-013169 | | 2/1999 |
| KR | 10-2007-0048166 | | 5/2007 |
| WO | WO2006/002224 | * | 1/2006 |
| WO | WO 2007/044222 | | 4/2007 |

OTHER PUBLICATIONS

International Search Report for PCT/KR2008/004126 dated Nov. 10, 2009.

* cited by examiner

*Primary Examiner* — Frantz Jules
*Assistant Examiner* — Cassey D Bauer
(74) *Attorney, Agent, or Firm* — KED & Associates, LLP

(57) ABSTRACT

A method of controlling an ice maker is provided that minimizes generation of excess water and reduces energy consumption. The method allows for uniform heat to be generated and distributed throughout the ice tray during an ice separation process. Consequently, the ice separating process may be consistently performed irrespective of the shape of the ice tray and its surroundings, thereby minimizing generation of excess water, and reducing energy consumption.

15 Claims, 8 Drawing Sheets

CONTROLLING METHOD OF ICE MAKER

This application claims the benefit of Korean Patent Application No. 10-2007-0071151, filed in Korea on Jul. 16, 2007, which is hereby incorporated by reference in its entirety as if fully set forth herein.

BACKGROUND

1. Field

This relates to a controlling method of an ice maker, and more particularly, to a controlling method of an ice maker that is capable of minimizing water generation and reducing energy loss.

2. Background

Generally, an ice maker is provided in a freezing apparatus, such as, for example, a refrigerator, a water purifier, a vending machine, or an ice making apparatus (hereinafter, referred to as "a refrigerator or the like"). In a simple ice making system, a container containing water is placed in a freezing chamber and the water is frozen below the freezing point to produce ice. A user then manually removes the ice from the freezing chamber. Automation of ice production may make this process faster and more efficient.

BRIEF DESCRIPTION OF THE DRAWINGS

The embodiments will be described in detail with reference to the following drawings in which like reference numerals refer to like elements wherein.

DETAILED DESCRIPTION

Reference will now be made to embodiments, examples of which are illustrated in the accompanying drawings. Wherever possible, the same reference numbers will be used throughout the drawings to refer to the same or like parts.

In an automated ice maker, water is automatically supplied to a container provided in a refrigerator or the like, the water in the container is frozen into ice, and a heater provided at or near the ice maker heats the container such that the ice is separated from the container.

When the container is heated by the heater to separate the ice from the container, water is necessarily generated due to the heat applied to the ice. This may cause pieces of the ice to stick to each other once they have been separated from the container, fallen into a storage bin, and the water has been re-frozen. This may also cause excess water to gather at the bottom of the ice maker. Further, if the heating process is carried out more than necessary, the power consumed by the heater may increase. Therefore, a control method that minimizes excess water generation and reduces power consumption during the ice separation process is desirable.

Referring to FIGS. 1 to 4, an ice maker 100 as embodied and broadly described herein may include an ice tray 110, a moving unit that moves the ice tray 110 to a position where ice may be separated from the ice tray 110, a water supply unit that supplies water to the ice tray 110, and a heating unit that heats the ice tray 110 so as to separate the ice from the ice tray 110.

Figure 1:
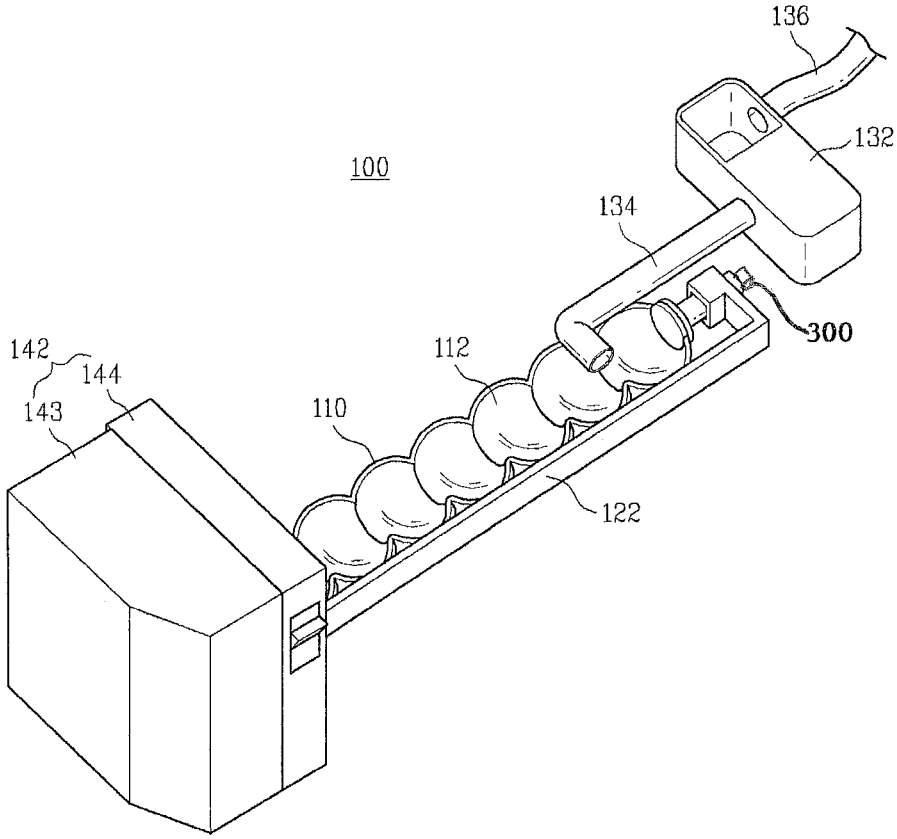
FIG. 1 is a perspective view of an ice maker as embodied and broadly described herein.

The ice tray 110 may include at least one receiving part 112 that receives water to produce ice. The top of the at least one receiving part 112 may include an opening through which water may be supplied, and through which the ice may be separated from the ice tray 110. As shown in FIG. 1, the ice tray 110 may include a plurality of receiving parts 112 provided as an assembly.

The ice tray 110 may be constructed such that the receiving parts 112 are arranged in a line, as in the embodiment shown in FIG. 1. In alternative embodiments, a plurality of receiving part lines, each of which includes a plurality of receiving parts arranged in a line, may be arranged parallel to each other. Other arrangements may also be appropriate.

The receiving parts 112 may be formed in various different shapes. For example, the receiving parts 112 may be formed in the shape of a hemisphere or a cube. Other shapes may also be appropriate, and the ice tray 110 may include receiving parts 112 formed in other, more complicated, shapes satisfying the likes and taste of a user, such as, for example, a star or a heart.

The moving part may move the ice tray 110 to an ice separation position such that, after the water contained in the ice tray 110 is frozen into ice, the produced ice may be separated from the ice tray 110. For example, the moving unit may be constructed to rotate the ice tray 110 about a central axis of the ice tray 110 that extends in the longitudinal direction of the ice tray 110 (for example, in the direction in which the receiving parts 112 are arranged in a line) such that the open top of each receiving part 112 of the ice tray 110 is directed downward after rotation. In alternative embodiments, the moving unit may be constructed to linearly move the ice tray 110.

For the purposes of rotating the ice tray 110, the moving unit may include a rotary member 122 coupled to opposite ends of the ice tray 110 and extending in the longitudinal direction of the ice tray 110, and a motor (not shown) coupled to the rotary member 112 to rotate the ice tray 110 as well as the rotary member 122. Consequently, when ice production is completed, the motor may be driven to rotate the ice tray 110, which is coupled to the rotary member 122. In alternative embodiments, the rotary member 122 may be fixed such that the motor rotates only the ice tray 110.

Figure 4:
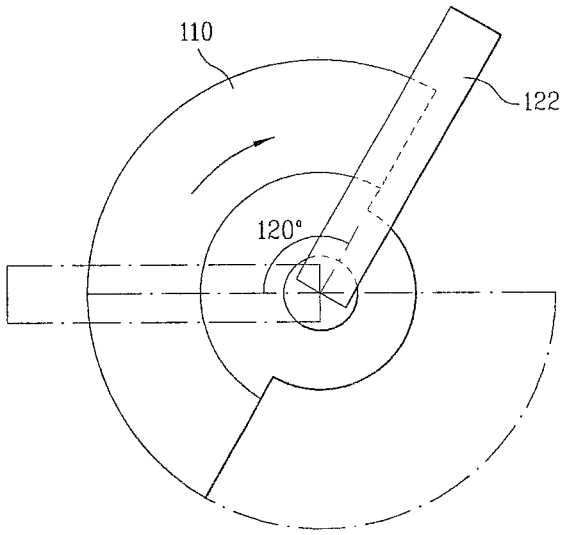
FIG. 4 is a side view illustrating rotation of the ice tray shown in FIG. 1 during an ice separation process.

In certain embodiments, the ice tray 110 may have a rotation angle of 90 to 180 degrees. For example, FIG. 4 illustrates rotation of the ice tray 110 by 120 degrees. When the rotation angle of the ice tray 110 is within this range, the ice, after being separated from the ice tray 110, may be directed into a space such as, for example, an ice storage bin (not shown) by virtue of its own weight, without further movement of the ice by an additional apparatus.

The water supply unit may be provided at one side of the moving unit to supply water to the ice tray 110. The water supply unit may include a storage container 132 that stores water, and a water supply pipe 134 that supplies water from the storage container 132 to the ice tray 110. The storage container 132 may be connected to a water supply hose 136 such that water is supplied to the storage container 132 from an external source. An opening and closing unit (not shown) may be provided at the connection between the water supply pipe 134 and the storage container 132 to control the flow of water such that water may be supplied to the ice tray 110 when needed.

The ice maker 100 may also include a heating unit that heats the ice tray 110 to facilitate separation of the ice from the ice tray 110. The heating unit may apply heat to an interface between the ice and the ice tray 110 to partially or entirely melt the ice at this interface. This melting allows a bond between the ice and the ice tray 110 to be released, and the ice to be separated from the ice tray 110.

The heating unit may be any kind of heater or heat generating member that can be controlled to be repeatedly turned on/off. In certain embodiments, the ice tray 110 may be made of a conductive material, and a pulse may be applied to the ice tray 110 such that the ice at the interface may be melted, and the ice may be separated from the ice tray 110.

For this purpose, the heating unit may include a current supplier 142 that supplies current to the ice tray 110. The current supplier 142 may include a power supply 143 and an input controller 144. In certain embodiments, the heating unit may be constructed to include the ice tray 110 also made of the conductive material.

In this instance, the ice tray 110 made of the conductive material allows current to flow therethrough. Thus, the ice tray 110 may be made of a material having a high electrical conductivity, such as, for example, copper (Cu), silver (Ag), aluminum (Al), a stainless steel alloy, an aluminum alloy, or other material as appropriate. When electrodes 114 are connected to the ice tray 110, and a pulse is applied to the ice tray 110, the ice tray 110 may be uniformly heated in a short period of time.

Figure 2A:
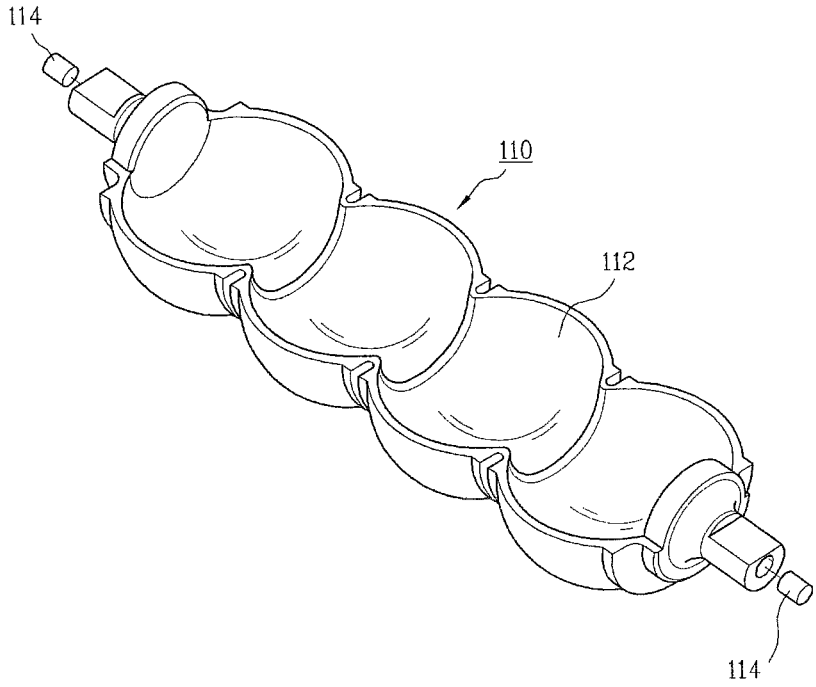
FIGS. 2A-2C are perspective views of ice trays used in the ice maker shown in FIG. 1.
Figure 2B:
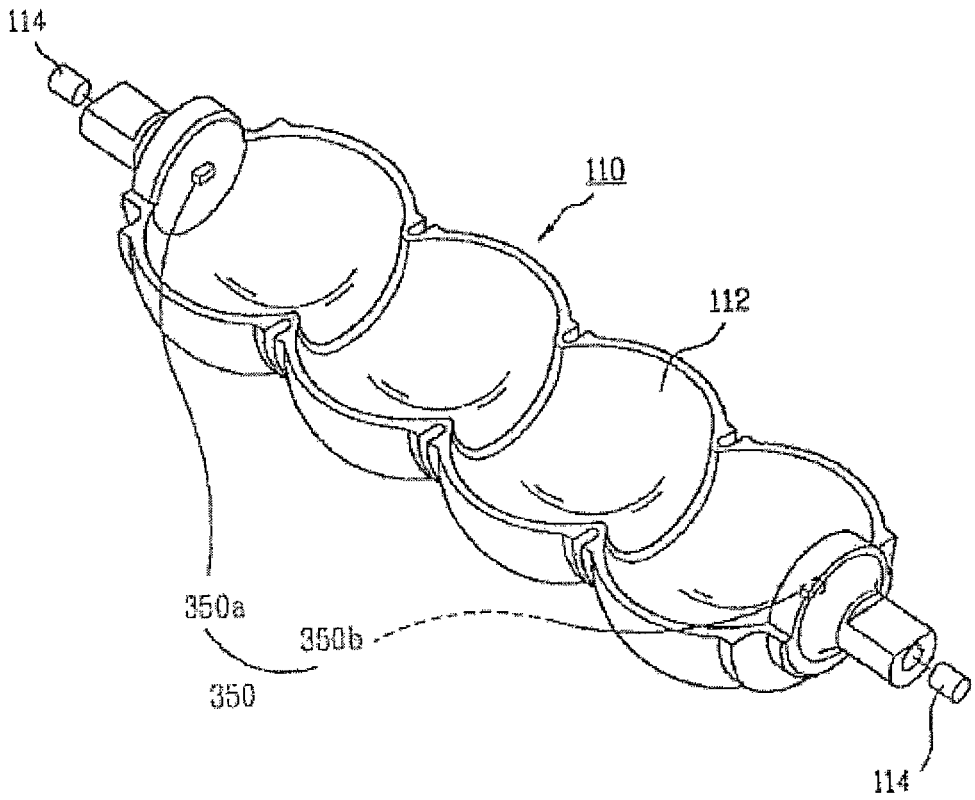
Figure 2C:
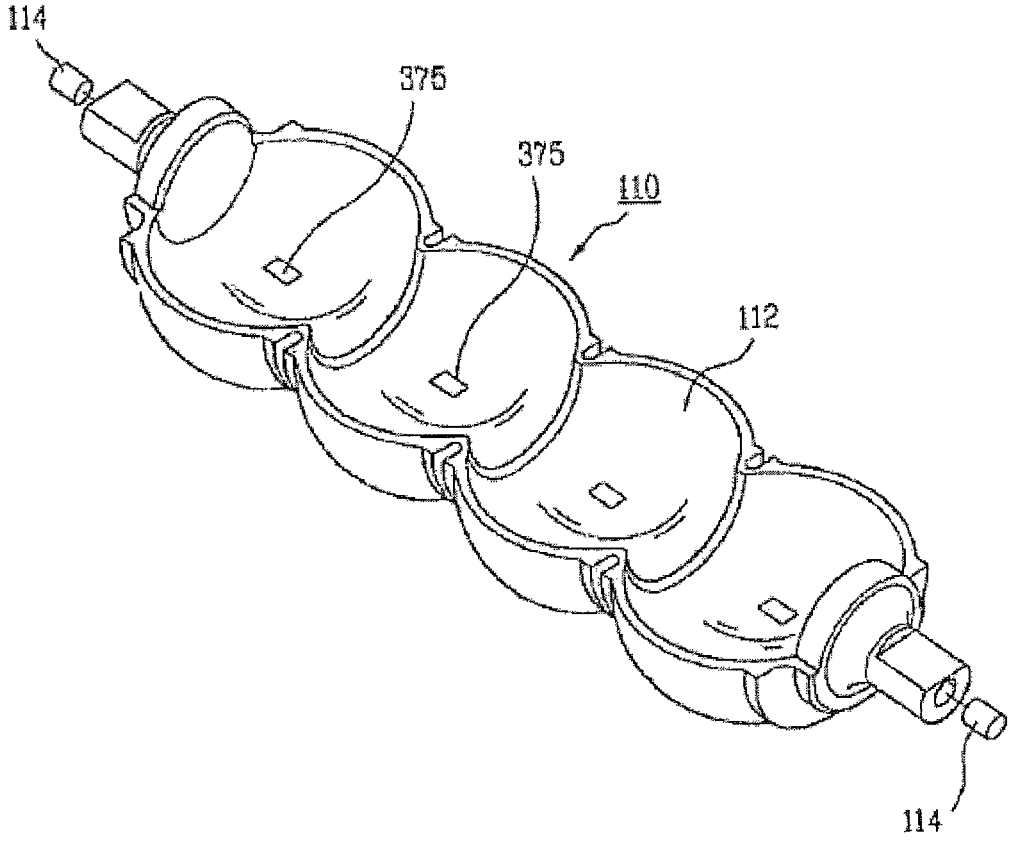

Us shown in FIGS. 2A-2C, electrodes 114 may be fitted in, for example, the opposite ends of the ice tray 110, and an electric circuit (not shown) may be connected to the electrodes 114 such that current flows through the ice tray 110. In this case, the electric circuit, which is connected to the electrodes 114, may be provided in the rotary member 122.

When a pulse is applied to the ice tray 110 for a predetermined period of time, and the ice tray 110 is heated, the ice may be melted at the interface between the receiving parts 112 of the ice tray 110 and the ice produced in the receiving parts 112. As a result of this melting, a bond between the ice and the receiving parts 112 may be released, and the ice may be separated from the receiving parts 112. At this point, the ice tray 110 has already been rotated downward, and therefore, the ice falls from the ice tray 110 and into a storage bin by virtue of its own weight.

The amount of heat generated through the ice tray 110 may be controlled by controlling the application of current supplied from the power supply 143 in the form of a pulse by the input controller 144. The input controller 144 may include, for example, a resistance circuit, a triac circuit, a coil circuit, or other type of circuit as appropriate.

Figure 3:
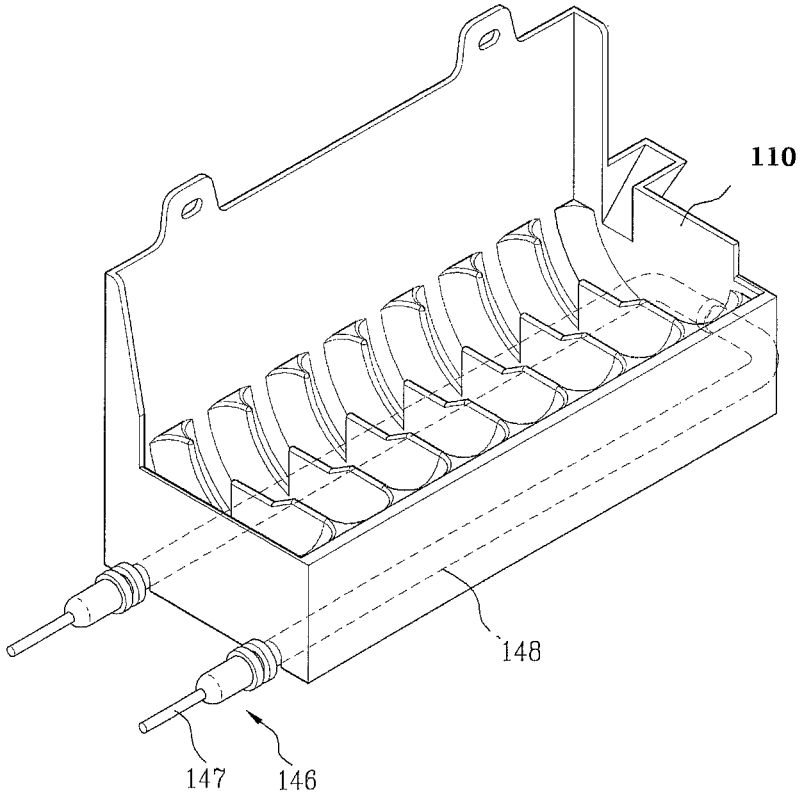
FIG. 3 is a perspective view of a heating unit of the ice maker shown in FIG. 1.

In the embodiment shown in FIG. 3, the heating unit of the ice maker 100 may include a heater 146 that is arranged to cover the ice tray 110. In this embodiment, the heater 146 may be controlled to be repeatedly turned on/off to achieve separation of ice from the ice tray 110.

The heater 146 may be, for example, a sheathed heater which may be manufactured by disposing an electric wire in a metal protection pipe in the shape of a coil and filling the metal protection pipe with magnesium oxide insulating powder. A sheathed heater may provide some advantages in this application, in that it may absorb external physical impacts, may increase the efficiency of electrical thermal energy, and may be formed in various shapes.

The heater 146 may include terminal parts 147, to which an electric circuit may be connected, and a heat generation part 148 that generates heat. The heater 146 may cover, or at least partially surround, the ice tray 110 to melt the interface surface of the ice produced in the ice tray 110 when the ice separating process is carried out.

In this embodiment, the heating unit includes the heater 146 as shown in FIG. 3 and described above; however, the other components of the heating unit may be the same as or similar to those of the heating unit shown in FIG. 1 that includes the current supplier 142. These other components are omitted from FIG. 3 simply for clarity.

Figure 5:
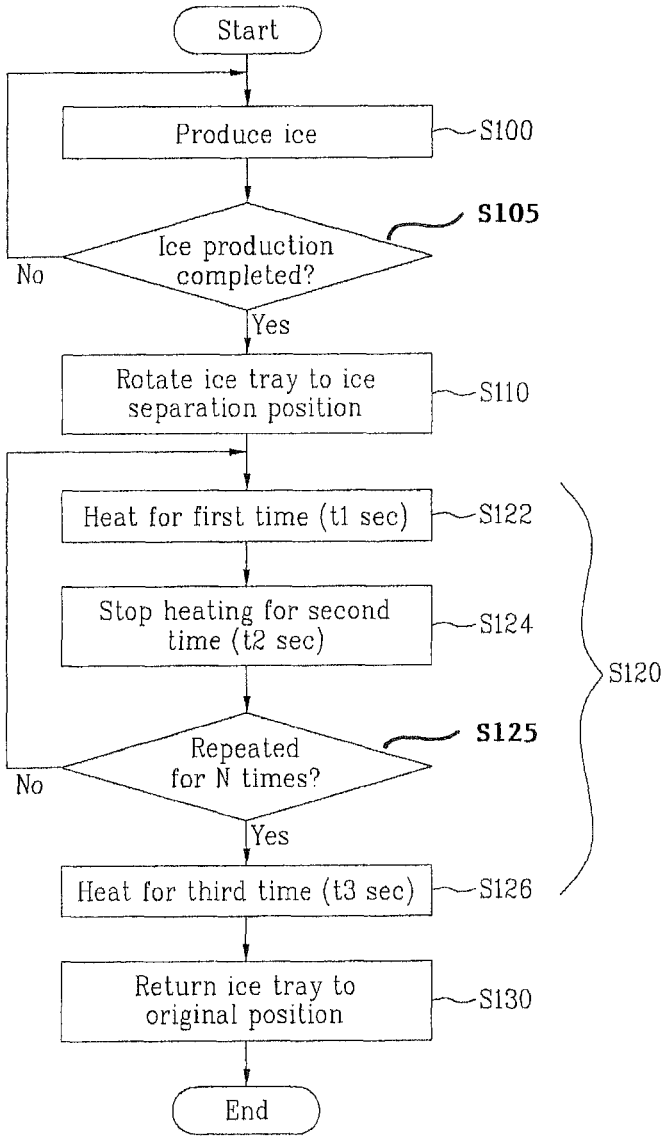
FIG. 5 is a flow chart of a controlling method of an ice maker as embodied and broadly described herein.

A controlling method of the ice maker as embodied and broadly described herein will now be described with reference to FIG. 5. The controlling method may include an ice making step (S100) including supplying water to the ice tray 110 and freezing the water to produce ice, a moving step (S110) including moving the ice tray 110 to an ice separation position, a heating step (S120) including intermittently heating the ice tray 110 such that the ice is separated from the ice tray 110, and a returning step (S310) including returning the ice tray 110, from which the ice has been separated, to its original position.

In more detail, when an ice making process is initiated, water stored in the storage container 132 flows to the receiving parts 112 of the ice tray 110 through the water supply pipe 134. At this time, a control unit (not shown) that controls overall operation of the ice maker 100 opens the opening and closing unit to allow the water to flow through the water supply pipe 134.

The temperature of the water received in the receiving parts 112 of the ice tray 110 is lowered below the freezing point by cool air supplied to the ice tray 110 to change the water into ice. The temperature of the ice tray 110 may be detected by a temperature sensor (not shown) or other suitable devices as appropriate. The control unit determines that the ice production has been completed when the detected temperature reaches a predetermined temperature level (S105).

After the completion of the ice making step (S100, S105), the control unit/moving unit moves the ice tray 110, now containing ice, to an ice separation position (S110). At the moving step (S110), the ice tray 110 is rotated to the ice separation position by the moving unit, and the ice falls out of the ice tray 110 and into a storage bin by virtue of its own weight. To achieve this rotation, the motor may generate a rotary force to rotate the ice tray 110 to the ice separation position together with the rotary member 122.

After the ice tray 110 has been rotated to the ice separation position, the control unit drives the heating unit to heat the ice tray 110 to facilitate separation of the ice from the ice tray 110 (S120). More specifically, the heating unit first heats the ice tray 140 for a first time (t1) (S122). For example, when the heating unit includes the current supplier 142, and the ice tray 110 is made of a conductive material, as shown in FIG. 1, a pulse may be applied to the ice tray 110 through the power supply 143, and the input controller 144 may control a period of time for which the pulse is applied to the ice tray 110.

In certain embodiments, the first time (t1) for which the ice tray 110 is heated, i.e., the first time (t1) for which the pulse is applied to the ice tray 110, may be greater than 0 and less than or equal to 10 seconds, i.e., $0<t1\leqq 10$ sec. The first time (t1) may be may be established based on the various attributes of the ice tray and/or the heating unit, for example, the size/shape of the receiving parts 112, material of the ice tray 110, magnitude of supplied current, size/shape/capacity of the heat generating part 148, and other such factors as appropriate.

After the ice tray 110 is heated for the first time (t1) (S122), the heating of the ice tray 110 is stopped for a second time (t2) (S124). In certain embodiments, the second time (t2) for which the application of the pulse to the ice tray 110 is stopped, may be greater than 0 and less than or equal to 180 seconds, i.e., $0<t2\leqq180$ sec. The second time (t2) may be established based on factors similar to those used to establish the first time (t1).

The steps of heating the ice tray 110 for the first time (t1) (S122) and stopping the heating of the ice tray 110 for the second time (t2) (S124) may be repeated for a predetermined number of times (N). Thus, during the ice separating process (S120), the ice tray 110 is not continuously heated for an extended period of time, which would cause an excessive accumulation of water, but rather, intermittently heated for periods (t1) with no heat periods (t2) between the heating periods (t1).

In certain embodiments, the number of times (N) the heating and no heating steps (S122, S124) are repeated may be greater than 0 and less than or equal to 20, i.e., $0<N\leqq20$ (times). The repeated number of times (N) may be established through, for example, experimental and experiential observations of cases in which the ice is entirely separated from the ice tray 110.

In this way, the ice tray 110 is not continuously heated, but intermittently heated, during the ice separation process (S120). Consequently, it is possible to prevent nonuniform heating and/or excessive heating of the ice tray depending upon positions of the ice tray 110 when the ice tray 110 is heated.

More specifically, the amount of current flowing through the ice tray 110 may change at the respective positions of the ice tray 110 depending upon the shape of the ice tray 110. As heating time of the ice tray 110 increases, this unbalance in the amount of heat generated due to the difference increases. However, by applying heat intermittently rather than continuously, heat gathered at a specific region has an opportunity to disperse during the off state (t2), making uniform heat generation and application to the ice tray 110 possible. Consequently, it is possible to optimally perform the ice separating process (S120) irrespective of the shape of the ice tray 110 and its surroundings, thereby minimizing excess water generation, and, eventually, reducing energy consumption.

After heating the ice tray 110 for the first time (t1) (S122) and stopping the heating of the ice tray 110 for the second time (t2) (S124) is repeated for the predetermined number of times (N) (S125), the ice tray 110 is heated for a third time (t3) (S126).

In certain embodiments, the third time (t3), during which a pulse may be applied to the ice tray 110, may be greater than 0 and less than or equal to 180 seconds, i.e., $0<t3\leqq180$ sec. The third time (t3) may be established based on factors similar to those used to establish the first time (t1) and the second time (t2).

The further heating of the ice tray 110 for the third time (t3) is provided to completely separate any ice which may still be left in the receiving parts 112 of the ice tray 110 even after repeatedly heating the ice tray 110 for the first time (t1) and stopping the heating of the ice tray 110 for the second time (t2) for the predetermined number of times (N). After the ice tray 110 is heated for the third time (t3) (S126), the control unit drives the motor to return the ice tray 110 to its original position (S130).

Figure 6:
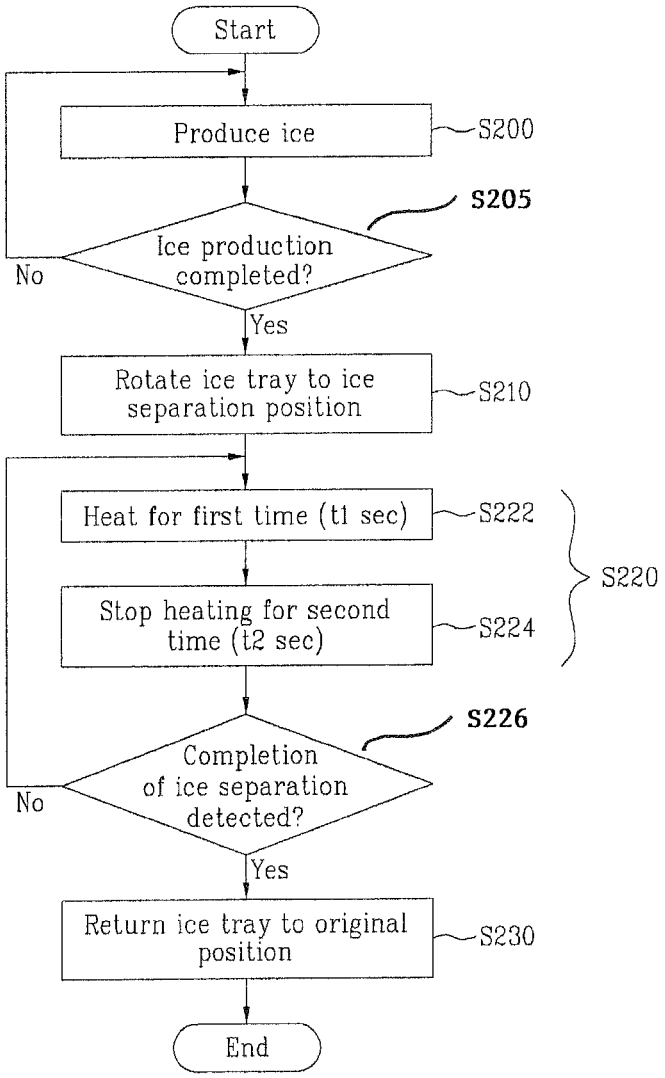
FIG. 6 is a flow chart of a controlling method of an ice maker including a sensor that detects completion of ice separation in accordance with embodiments as broadly described herein.

A controlling method of an ice maker including a sensor that detects completion of ice separation will now be described. As shown in FIG. 6, water is supplied to the ice tray 110 by the water supply unit, and the temperature of the water is lowered below the freezing point to change the water into ice (S200). As in the previous embodiment, the temperature of the ice tray 110 may be detected by a temperature sensor provided with the ice tray 110. The control unit determines that ice production has been completed when the detected temperature reaches a predetermined temperature level (S205).

After the completion of the ice making step (S200, S205), the control unit/moving unit move the ice tray 110 to an ice separation position (S210). At this time, the motor is rotated to rotate the ice tray 110 to the ice separation position together with the rotary member 122.

After the ice tray 110 is rotated to the ice separation position, the control unit drives the heating unit to heat the ice tray 110 so that the ice may be separated from the ice tray 110 (S220). More specifically, the heating unit first heats the ice tray 110 for a first time (t1) (S222). When the heating unit includes the current supplier 142, and the ice tray 110 is made of a conductive material, a pulse is applied to the ice tray 110 through the power supply 143, and the input controller 144 controls a period of time for which the pulse is applied to the ice tray 110.

In certain embodiments, the first time (t1) for which the pulse is applied to the ice tray 110 may be greater than 0 and less than or equal to 10 seconds, i.e., $0<t1\leqq10$ sec. After the ice tray 110 is heated for the first time (t1) (S122), the heating of the ice tray 110 is stopped for a second time (t2) (S224). In certain embodiments, the second time (t2) for which the application of the pulse to the ice tray 110 is stopped may be greater than 0 and less than or equal to 180 seconds, i.e., $0<t2\leqq180$ sec.

As discussed above, the ice maker may also include an ice separation completion detecting sensor to detect whether the ice has been completely separated from the ice tray 110. Numerous different types of sensors may be appropriate for use as the ice separation completion detecting sensor. For example, the ice separation completion detecting sensor may be a moment sensor 300 provided at the connection between the rotary member 122 and the motor to detect a change in moment, as shown in FIG. 1. Alternatively, the ice separation completion detecting sensor may be a photosensitive sensor 350 including a light emitting part 350*a* and a light receiving part 350*b* provided at opposite ends of the ice tray 110, as shown in FIG. 2B. A weight sensor 375 may also be used as the ice separation completion detecting sensor, as shown in FIG. 2C.

When the ice maker includes an ice separation completion detecting sensor as described above, therefore, heating the ice tray 110 for the first time (t1) (S222) and stopping the heating of the ice tray 110 for the second time (t2) (S224) may be repeated until completion of ice separation is detected by the ice separation completion detecting sensor (S226).

In certain embodiments, the ice separation completion detecting sensor may detect whether the ice has been completely separated from the ice tray 110 (S226) while the heating of the ice tray 110 is stopped, i.e., during the second time (t2) (S224). If the ice separation completion detecting process (S226) were instead carried out during the application of the pulse to the ice tray 110 (S222), the application of the pulse to the ice tray 110 may interfere with the detection of the ice separation completion by the ice separation completion detecting sensor, thus causing the ice separation completion detecting sensor to malfunction. After the ice separation is completed, the control unit drives the motor to return the ice tray 110 to its original position (S230).

Thus, in the controlling method of the ice maker as embodied and broadly described herein, the ice tray is not continuously heated, but rather, intermittently heated. Consequently, it is possible to uniformly heat the ice tray and prevent non-uniform heating/variation in heating depending on positions of the ice tray.

Further, by repeatedly carrying out the on/off control of the heating unit, heat gathered at a specific region is able to disperse during the off state, allowing heat to be mixed at all regions of the ice tray, and uniform heat generation/distribution is possible.

Additionally, because the ice tray is uniformly heated, excess water generation may be minimized. Because the amount of melting in the ice is minimized, it is possible to keep the ice in the shape desired by a user, and it is possible to optimally perform the ice separating process irrespective of the shape of the ice tray and its surroundings, thereby reducing energy consumption.

A controlling method of an ice maker that is capable of minimizing water generation and reducing energy loss is provided.

A controlling method of an ice maker, as embodied and broadly described herein, may include supplying water to an ice tray and freezing the water to produce ice, moving the ice tray to an ice separation position to separate the produced ice from the ice tray, repeatedly heating the ice tray such that the ice is separated from the ice tray, and returning the ice tray, from which the ice has been separated, to its original position.

Moving the ice tray to an ice separation position to separate the produced ice from the ice tray may include rotating the ice tray such that the ice falls by virtue of its own weight.

Repeatedly heating the ice tray such that the ice is separated from the ice tray may include heating the ice tray for a first time. After the ice tray is heated for the first time, the heating of the ice tray may be stopped for a second time. Heating the ice tray for the first time and stopping the heating of the ice tray for the second time may be repeatedly carried out for a predetermined number of times.

After heating the ice tray for the first time and stopping the heating of the ice tray for the second time is repeatedly carried out for the predetermined number of times, the ice tray may be further heated for a third time.

The ice tray may exhibit electric conductivity, and the heating of the ice tray may be accomplished by applying a pulse to the ice tray for the first time and for the third time.

Repeatedly heating the ice tray such that the ice is separated from the ice tray may include repeatedly performing heating the ice tray for the first time and stopping the heating of the ice tray for the second time until it is detected, by a sensor mounted at the ice tray, that the ice has been completely separated from the ice tray.

The sensor may detect whether the ice has been completely separated from the ice tray while the heating of the ice tray is stopped.

An ice making method of an ice maker as embodied and broadly described herein may include supplying water to an ice tray and freezing the water to produce ice, moving the ice tray to separate the produced ice from the ice tray, and repeatedly performing an operation including heating the ice tray for a first time and stopping the heating of the ice tray for a second time.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling an ice maker, the method comprising:

supplying water to an ice tray positioned at an initial position and freezing the water to produce ice;

moving the ice tray to an ice separation position and initiating an ice separation cycle, and maintaining the ice tray at the ice separation position until the ice separation cycle is complete, the ice separation cycle comprising:

rotating the ice tray such that separated ice falls out of the ice tray by virtue of its own weight; and intermittently heating the ice tray so as to separate the ice from the ice tray, comprising:

heating the ice tray for a first time period;

stopping the heating of the ice tray for a second time period after heating the ice tray for the first time period;

repeatedly and alternately heating the ice tray for the first time period and stopping the heating of the ice tray for the second time period multiple times; and thereafter heating the ice tray for a third time to complete the ice separation cycle;

returning the ice tray to the initial position upon completion of the ice separation cycle; and detecting whether the bond between the ice and the ice tray is released by providing a moment sensor to detect a change in a moment applied to the ice tray caused by a weight of the ice.

2. The method of claim 1, wherein water is supplied to the ice tray through open portions in the ice tray, and wherein rotating the ice tray comprises rotating the ice tray about a longitudinal axis of the ice tray so as to move the open portions of the ice tray from an upward facing orientation in the initial position to a downward facing orientation in the ice separation position.

3. The method of claim 1, wherein repeatedly and alternately heating and stopping the heating comprises alternately heating and stopping the heating a predetermined number of times.

4. The method of claim 1, wherein the ice tray is made of a conductive material, and wherein heating the ice tray for the first time period and for the third time period comprises applying a pulse to the ice tray during the first time period and during the third time period.

5. The method of claim 1, wherein intermittently heating the ice tray comprises repeatedly heating the ice tray for the first time period and stopping the heating of the ice tray for the second time period until the moment sensor detects that the ice has separated from the ice tray.

6. The method of claim 5, wherein the moment sensor detects whether the ice has separated from the ice tray during the second time period, while the heating of the ice tray is stopped.

7. The method of claim 1, wherein the second time period is greater than the first time period, and the third time period is greater than the first time period.

8. An ice making method, comprising:

supplying water to an ice tray positioned at an initial position, and freezing the water to produce ice; and moving the ice tray to an ice separation position and initiating an ice separation cycle, and maintaining the ice tray at the ice separation position until the ice separation cycle is complete, the ice separation cycle comprising:

heating the ice tray for a first time period;

stopping the heating of the ice tray for a second time period that is greater than the first time period; and repeating the heating and stopping steps multiple times until detecting that a bond between the ice and the ice tray is released and the separation cycle is completed wherein the detecting that the bond between the ice and ice tray is released comprises providing a moment sensor to detect a change in a moment applied to the ice tray caused by a weight of the ice.

9. The method of claim 8, wherein the first time period is greater than 0 seconds and less than or equal to 10 seconds.

10. The method of claim 8, wherein the second time period is greater than 0 seconds and less than or equal to 180 seconds.

11. The method of claim 8, wherein the heating and stopping steps are carried out more than 1 time and less than or equal to 20 times.

12. The method of claim 8, further comprising heating the ice tray for a third time period after heating and stopping steps have been repeatedly carried out for a predetermined number of times.

13. The method of claim 12, wherein the third time period is greater than 0 seconds and less than or equal to 180 seconds.

14. The method of claim 8, wherein the moment sensor provided at an interface between a motor and a rotary member coupled to the ice tray.

15. The ice making method according to claim 8, further comprising returning the ice tray, from which the ice has been separated, to the initial position.

* * * * *